US006410065B1

(12) United States Patent
Nottingham et al.

(10) Patent No.: US 6,410,065 B1
(45) Date of Patent: Jun. 25, 2002

(54) EXPANSIBLE FOOD CONTAINER

(75) Inventors: John R. Nottingham; John W. Spirk, Jr., both of Moreland Hills; Dale Panasewicz, Strongsville, all of OH (US)

(73) Assignee: Nottingham-Spirk Design Associates, Inc., Cleveland, OH (US)

( * ) Notice: Subject to any disclaimer, the term of this patent is extended or adjusted under 35 U.S.C. 154(b) by 0 days.

(21) Appl. No.: 07/902,957

(22) Filed: Jun. 23, 1992

Related U.S. Application Data

(63) Continuation-in-part of application No. 07/475,420, filed on Feb. 5, 1990, now abandoned, which is a continuation-in-part of application No. 07/331,081, filed on Mar. 27, 1989, now Pat. No. 4,898,561, which is a continuation of application No. 07/103,025, filed on Sep. 30, 1987, now abandoned, which is a continuation of application No. 06/879,915, filed on Jun. 27, 1986, now abandoned.

(51) Int. Cl.[7] ..... B65B 25/22

(52) U.S. Cl. ..... 426/87; 426/104; 426/111; 426/107; 426/112; 426/113; 206/457; 383/3; 383/4; 383/120; 383/902; 383/907; D9/307; D9/305; 219/727

(58) Field of Search ..... 426/107, 111, 426/104, 87, 113, 112; 446/220; 383/2–4, 902, 907, 120; 206/457; D9/307, 311, 305, 318; 219/727

(56) References Cited

U.S. PATENT DOCUMENTS

| | | | |
|---|---|---|---|
| 1,216,425 | A | 2/1917 | Eiseman |
| 1,247,809 | A | 11/1917 | Foster |
| 1,348,761 | A | 8/1920 | Stoner |
| 1,356,817 | A | 10/1920 | Gregory |
| 1,536,816 | A | 5/1925 | Sale |
| 1,715,757 | A | 6/1929 | Hirtzler |
| 1,800,990 | A | 4/1931 | Forrest |
| 1,881,048 | A | 10/1932 | Dorogi et al. |
| 1,969,128 | A | 8/1934 | Harrison |
| 2,000,242 | A | 5/1935 | Manning |
| 2,082,671 | A | 6/1937 | Walker |
| 2,102,329 | A | 12/1937 | Nelson et al. |
| 2,149,616 | A | 3/1939 | McGuire |

(List continued on next page.)

FOREIGN PATENT DOCUMENTS

| | | |
|---|---|---|
| DE | 236505 | 7/1925 |
| GB | 303593 | 1/1929 |

*Primary Examiner*—Steven Weinstein
(74) *Attorney, Agent, or Firm*—Calfee, Halter & Griswold LLP

(57) ABSTRACT

An expansible container is provided for use during the cooking of food in a radiant energy device such as a microwave oven, with the container being configured or otherwise designed to provide entertainment to onlookers as the container expands in size during the relative rapid cooking of food in the container and/or with the fully expanded container of cooked food providing an interesting article, character, figure or configuration that is of novel, interesting or entertaining appearance. The container is formed from relatively flexible materials that define a closed chamber which contains food to be cooked. In its deflated form, the container is collapsed to assume a relatively flat, thin configuration which, in most preferred practice, displays or is configured to provide an entertaining or amusing shape. The inflation of the container during cooking of its food contents in a device such as a microwave oven may be rendered even more entertaining by selecting the food contents to comprise a substance such as popcorn that generates various types of entertaining noises such as "popping" noises during the cooking process. Once inflated, the container retains its expanded or inflated form to provide a measure of lasting entertainment or amusement. If popping corn is the food being cooked, the cooking time typically requires about one to about six minutes.

18 Claims, 12 Drawing Sheets

U.S. PATENT DOCUMENTS 2,373,529 A 4/1945 Beal
2,516,552 A 7/1950 Clark et al.
D161,734 S 1/1951 Burkes
2,665,519 A 1/1954 Burkes
2,673,805 A 3/1954 Colman
2,698,496 A 1/1955 Miller
2,710,037 A 6/1955 Caldwell
2,909,203 A 10/1959 Reaves
3,052,554 A 9/1962 Colman
3,442,043 A 5/1969 Panzer
3,835,280 A 9/1974 Gades et al.
3,835,308 A 9/1974 Reese
3,973,045 A 8/1976 Brandberg et al.
4,036,423 A * 7/1977 Gordon ..... 426/111
4,038,425 A * 7/1977 Brandberg et al. ..... 426/107
4,448,309 A 5/1984 Roccaforte
4,453,665 A 6/1984 Roccaforte et al.
4,547,167 A 10/1985 Bergmann
4,571,337 A * 2/1986 Cage et al. ..... 426/107
4,584,202 A * 4/1986 Roccaforte ..... 426/111
D287,334 S 12/1986 Ferrero
4,678,882 A * 7/1987 Bohrer et al. ..... 426/107
4,691,374 A 9/1987 Watkins et al.
4,716,061 A * 12/1987 Winter ..... 426/107
4,735,513 A * 4/1988 Watkins et al. ..... 426/107
4,765,999 A * 8/1988 Winter ..... 426/107
4,810,844 A * 3/1989 Anderson ..... 426/107
4,864,090 A * 9/1989 Maxwell et al. ..... 426/107
4,865,854 A * 9/1989 Larson ..... 426/107
4,874,620 A 10/1989 Mendenhall, et al.
4,892,744 A 1/1990 Ylvisaker
4,898,561 A 2/1990 Nottingham et al.
5,294,764 A * 3/1994 Mass ..... 426/243

* cited by examiner

EXPANSIBLE FOOD CONTAINER

CROSS-REFERENCE TO RELATED APPLICATIONS

The present application is a continuation-in-part of application Ser. No. 07/475,420, filed Feb. 5, 1990, now abandoned, which is a continuation-in-part of application Ser. No. 07/331,081 filed Mar. 27, 1989 and issuing Feb. 6, 1990 as U.S. Pat. No. 4,898,561. Application Ser. No. 07/331,081 was filed as a continuation of application Ser. No. 07/103,025 filed Sep. 30, 1987, now abandoned, as a continuation of application Ser. No. 05/879,915 filed Jun. 27, 1986, now abandoned, all of which are referred to hereinafter as the "Parent Cases," the disclosures of all of the Parent Cases being incorporated herein by reference. Moreover, the benefits of the filing dates of the Parent Cases are hereby claimed inasmuch as the subject matter of the present application is similar in many respects to that of the Parent Cases.

FIELD OF THE INVENTION

The present invention relates to the provision and use of an expansible food container that incorporates features which provide entertainment before, during and/or after the container has been expanded during a process of cooking its contents in a radiant energy environment such as is provided by the cooking chamber of a microwave oven, with the container being expanded from a relatively thin, generally "collapsed" state to a relatively inflated, three-dimensional or "expanded" state in a matter of a relatively brief period of time, and with the container being configured or otherwise designed to provide entertainment to onlookers as the container expands in size during the relative rapid cooking of the food contents of the container, and with the expanded container preferably also providing a structure that is of entertaining, interesting or amusing configuration or appearance, and from which cooked food can be served.

BACKGROUND OF THE INVENTION

Inflatable devices of a variety of types are known that are designed to be shipped in a collapsed, basically deflated state and inflated by an end purchaser. By way of example, inflatable toys are known that are shipped in a deflated state so that a maximum number of the toys can be packaged in a minimum of space for shipment and storage.

Other self-inflating articles of various types also are known, typical among these being toys such as figurines, and flotation devices such as rafts, life preservers, and the like. Some of these articles utilize canisters of pressurized gas that are opened to effect inflation. Others utilize chemical reactions of various types to generate pressurizing gases.

Likewise, expansible containers that carry food contents such as popcorn that can be cooked as by inserting a closed container of popcorn into the cooking chamber of a microwave oven to effect relatively rapid "popping" of the corn and attendant expansion of the container also are known.

For example, on microwaveable popcorn container is shown in U.S. Pat. No. 4,448,309 to Roccaforte et al. This patent discloses uncooked popcorn sealed within a substantially oxygen impermeable, flexible, synthetic high polymer film pouch which is dimensioned to fit for storage and microwave cooking of the popcorn in an outer bowl-like protective paperboard container. The mass of uncooked popcorn has a dimension which is selected so that the circumference of the popcorn mass substantially coincides with the periphery of the outer mouth of the container and seats along the sloping walls and the base of the container.

Another microwaveable popcorn container is shown in Brandberg et al, U.S. Pat. No. 3,973,045. This patent discloses uncooked popcorn sealed in a gusseted paper package. The uncooked popcorn is located in a center folded section of the package, and during popping, unpopped kernels and oil collect in the center of the package because of vibrations of the package and gravity.

However, the Roccaforte and Brandberg popcorn containers are not without drawbacks. For example, the Roccaforte container supports a portion of the unpopped popcorn in the package along the sides of the container away from the cooking surface of the microwave oven. However, it is believed that popcorn is most efficiently cooked in a microwaveable container when the entire mass of popcorn is supported proximate the cooking surface of the microwave oven, and preferably located in a portion of a container that is in planar, surface-to-surface contact with the cooking surface of the microwave oven. Thus placed, there is an optimum chance of locating the mass of uncooked popcorn in the peak energy zone of the microwave oven and for therefore having the greatest amount of popped corn. Similarly, although Brandberg alleges that the unpopped kernels and oil collect in the center portion of the package during popping, there is no structure disclosed that would prevent the uncooked popcorn (and oil) from spilling into the side portions of the package, and hence being supported in a portion of the package that extends away from the cooking surface.

Further, both the Roccaforte and Brandberg containers have packages or pouches with side and bottom walls which form common shapes when fully inflated (i.e., a rectangular package (Brandberg) or a circular pouch dictated by the shape of the supporting container (Roccaforte)). These packages/pouches do not have walls which are preformed so as to provide a predetermined article, character, figure or configuration which is defined by the preformed walls and which is novel, interesting or entertaining in appearance when the package or pouch is fully inflated. Rather, the wall structure of the previously proposed popcorn containers is chosen simply to minimize the space the container occupies and to provide functionally expansible structures that are of minimal cost to produce.

In fact, it is believed that the Brandberg package, being formed from paper (e.g. kraft paper), would probably be too stiff to form a predetermined article other than a simple bag when inflated. On the other hand, the Roccaforte pouch is formed form thin polymer film which does not appear to hold any particular form whatsoever when inflated aside from the form of the supporting container.

Moreover, these common package and pouch configurations, although useful for containing the cooked popcorn, are not intended to provide animated effects both during and after the popcorn cooking process. In other words, the final configuration of the popcorn package/pouch is known ahead of time—the Brandberg package will inflate to a rectangular shape, while the Roccaforte pouch will inflate to the shape of the supporting container. There is not intended to be surprise, entertainment or amusement as the package/pouch is inflated during the cooking process.

SUMMARY OF THE INVENTION

The present invention represents an extension and application of features and combinations of features of the invention of the referenced Parent Cases to containers of food stuffs and the like that are expanded as by application of radiant energy, and to the use of such containers to provide an entertainment medium, for example as by utilizing the radiant energy environment of the cooking chamber of a microwave oven or the like to cause food such as popcorn that is carried within the containers to "self-inflate" the containers over a relatively brief period of time, with the expansion of the containers causing features thereof to change in appearance in an interesting manner, with these changes preferably being accompanied by cooking noises such as is produced by the "popping" of popcorn.

The present invention addresses needs that are not addressed by inflatable toys of prior proposals, nor by present-day expansible microwaveable popcorn containers and the like, by providing an expansible food container that has features which render entertaining the very process of the container's expansion, and with the container preferably also being designed to feature entertaining configurations before and/or after its inflation or expansion.

One aspect or feature of the preferred practice of the present invention relates to the provision of an expansible food container that is configured or otherwise designed to provide entertainment to onlookers as the container expands in size during the relative rapid cooking of food in the container.

Another aspect or feature of the preferred practice of the present invention relates to the provision of an expansible food container that expands in size during the relatively rapid cooking of food in the container so that, at the conclusion of a process of that involves the cooking of food in the container, a container shape or configuration is generated that is of interesting and entertaining appearance.

A further aspect or feature of the preferred practice of the present invention relates to a method of providing entertainment as by utilizing an expansible food container that is configured or otherwise designed to be positioned in a cooking compartment of a radiant energy cooking device such as a microwave oven and viewed through a window or on an observation screen that displays what takes place during the cooking process so as to provide entertainment to onlookers during the relative rapid cooking of food in the container, with the container being caused to expand during the cooking process to progressively define, form or otherwise provide an interesting article, character, figure or configuration that is novel, interesting or entertaining in appearance. If popping corn is the food being cooked, the cooking time typically requires about one to about six minutes, with the majority of the inflation of the container taking place during the latter half of the cooking process.

In accordance with the preferred practice of the present invention, an expansible food container has structure that defines a closed chamber within which food to be cooked is carried, with the container and its contents normally assuming a relatively small volume configuration prior to cooking of the food contents of the container. In preferred practice, outer surface portions of the container are configured, printed or otherwise provided with an entertaining appearance, design or expression, which features change or expand or are progressively enhanced as by bringing other portions of the container into view as the container progressively inflates, unfolds and/or expands from a generally collapsed or deflated state to an expanded or inflated state. The expansion or inflation of the container may be rendered even more entertaining either by incorporating into the structure of the container components that have surface portions which engage and move relative to each other to generate a variety of noises during the expansion or inflation process (as is described in the referenced Parent Cases), and/or by utilizing food contents such as popcorn that produce entertaining and attention-attracting noises that accompany the expansion or inflation process. Once expanded, the container preferably retains its inflated form to provide a degree of lasting interest and amusement.

According to a further aspect or feature of the preferred practice of the present invention, the structure which defines a closed chamber for the expansible food container includes inner and outer surface layers comprising sheets of flexible, heat sealable material which are joined together around their periphery, and a separate base portion or tray which serves as a receptacle for the uncooked popcorn and which is attached to the inner and outer surface layers and supports the inner and outer surface layers when the expansible food container is fully expanded or inflated. The tray has a bottom surface which is in planar, surface-to-surface contact with the cooking surface of the microwave oven and therefore locates the mass of uncooked popcorn in the peak energy zone of the microwave oven for maximum popping effectiveness.

Moreover, the tray acts as a stable base for the expansible food container during assembly thereof, and the same tray (with or without the mass of popcorn preassembled therewith) can be used with a variety of outer surface layers having surface portions with different entertaining appearances, designs or expressions thereon. Therefore, there is a certain amount of manufacturing flexibility in having a common tray for the expansible food container.

BRIEF DESCRIPTION OF THE DRAWINGS

These and other aspects and features, and a fuller understanding of the invention may be had by referring to the following description and claims taken in conjunction with the accompanying drawings, wherein:

DESCRIPTION OF THE PREFERRED EMBODIMENT

Figure 1:
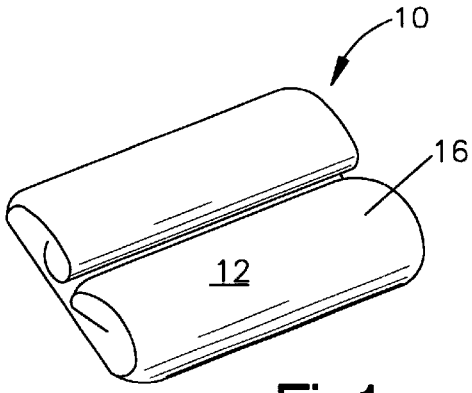
FIG. 1 is a perspective view of an expansible food container that embodies one form of the preferred practice of the present invention, with the container being depicted in an essentially deflated or collapsed state.
Figure 2:
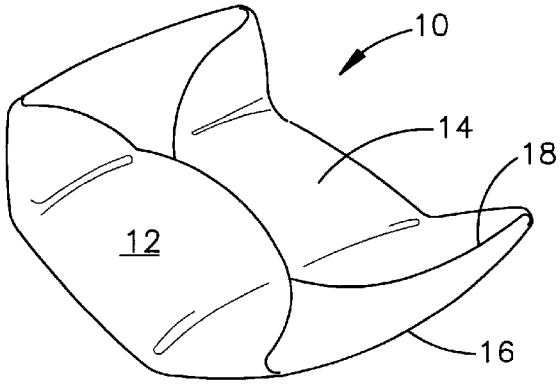
FIG. 2 is a perspective view similar to FIG. 1 but with the container being depicted during an early stage of inflation or expansion.
Figure 3:
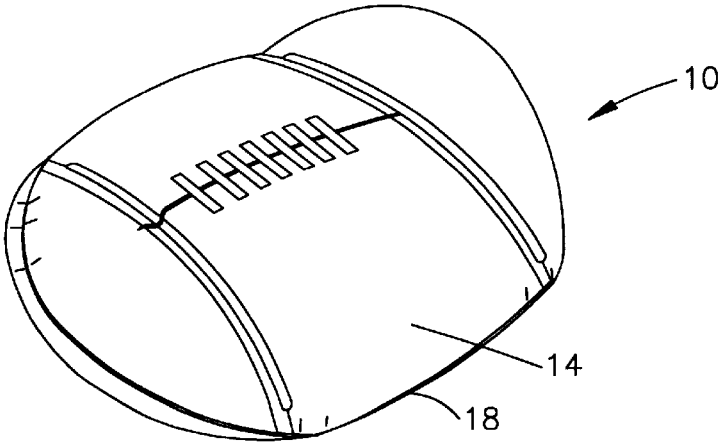
FIG. 3 is a perspective view thereof as the container is about midway through the inflation or expansion process.
Figure 4:
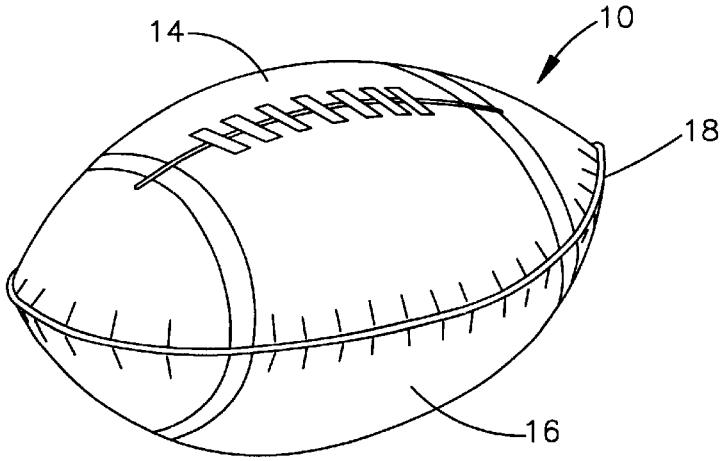
FIG. 4 is a perspective view of the container of FIG. 1 in its fully inflated or expanded state, and with the container being shaped like and having appearance features that are characteristic of a football.

Referring to FIGS. 1 through 4 (and shortly to the associated exploded view of FIG. 5), a food container embodying the preferred practice of the present invention is indicated generally by the numeral 10. The container 10 initially takes a relatively flat, folded, essentially two-dimensional form that will be referred to as its "deflated form," which is depicted in FIG. 1. Inflation or expansion of the container 10 takes place progressively, successive partially inflated or expanded states being illustrated in FIGS. 2 and 3, and with the final fully inflated or fully expanded state of the container 10 being shown in FIG. 4.

As will be apparent from an examination of what is depicted in FIGS. 1–4, the container 10 has a relatively unobtrusive and substantially conventional, generally rectangular and folded appearance in its collapsed state, as is depicted in FIG. 1. However, as progressive expansion or inflation of the container 10 takes place, surface carried features of the expanding container structure 10 are brought into view and/or are progressively enlarged and enhanced in character as the container 10 unfolds and/or inflates so that the resulting structure takes on a three-dimensional character that is of interesting appearance. The expansion of the container 10 takes place in a way that is entertaining, perhaps even amusing, to view, and that tends to attract attention and to entertain the viewer, for what its surface carried features taken together with the configuration of its component parts combine to produce is a food container 10 that, in its fully inflated or expanded state, is shaped like and has appearance features that are characteristic of a football.

Figure 5:
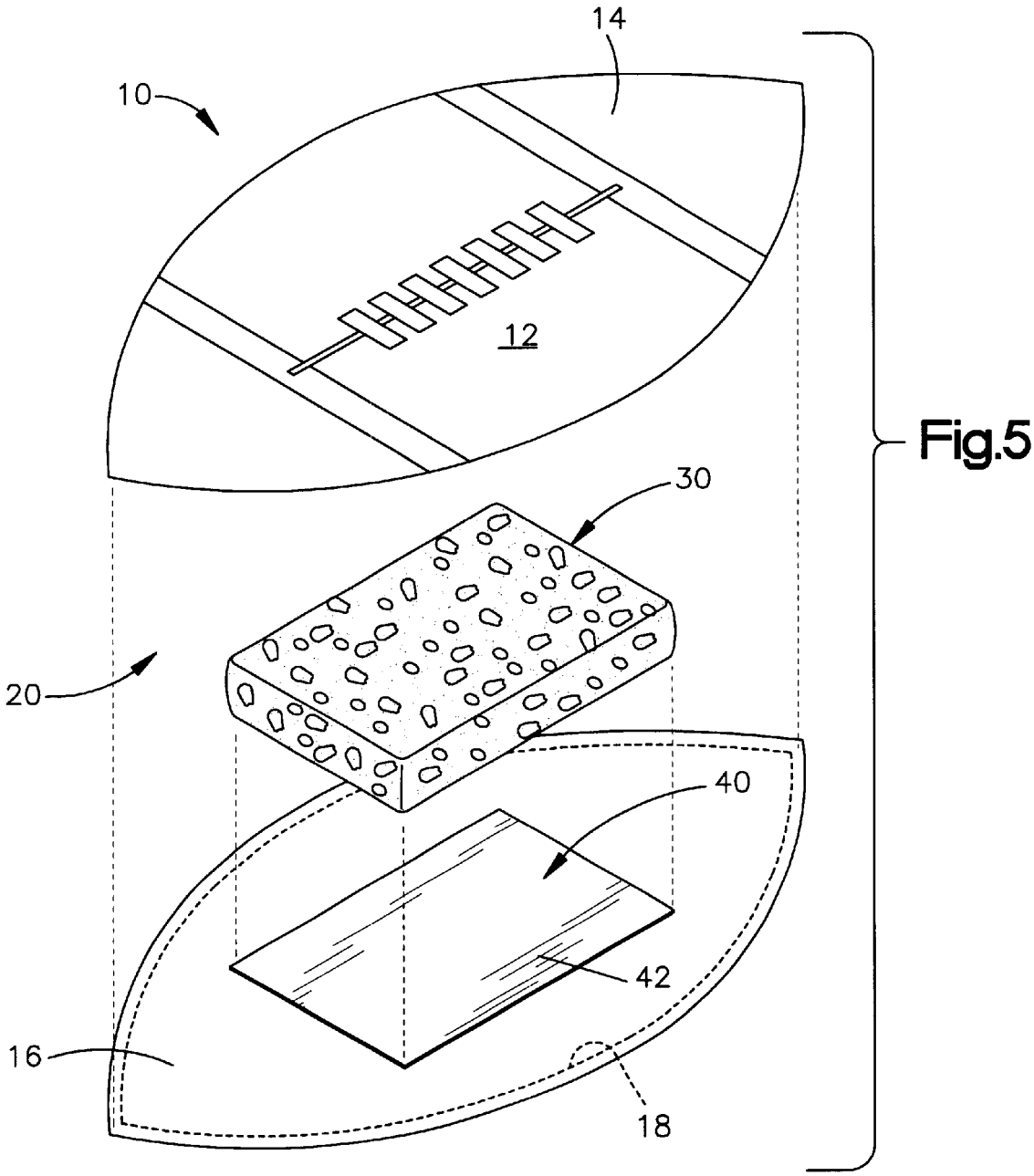
FIG. 5 is an exploded perspective view of components that comprise the food container of FIG. 1.

Referring to FIG. 5, the container 10 has an outer surface 12 that is formed from a pair of generally outwardly convex, somewhat semispherically shaped members 14, 16 that have been vacuum formed or otherwise shaped to depict such novelty features as opposed halves of a football. The members 14, 16 are closed along a perimetrically extending line or junction that is indicated by the numeral 18, whereby the members 14, 16 cooperate to define a closed chamber interiorally of the container 10. While a closed chamber is not, per se, depicted in FIG. 5, it is indicated generally by the reference numeral 20 which designates a space that is located between the members 14, 16 and about which the seam 18 extends. It is the chamber 20 that is expanded or inflated so as to expand the container 10 from its deflated state shown in FIG. 1 to its fully inflated state shown in FIG. 4, as will be explained.

Referring again to FIG. 5, a mass of food stuffs contained within the closed chamber 20 is indicated generally by the numeral 30. If, by way of example, the mass of food stuffs 30 is intended to be subjected to a field of radiant energy such as microwave energy generated in the cooking chamber of a microwave oven (shown only in FIG. 23), the mass of food stuffs 30 then typically comprises about three to six ounces of a combination of "unpopped" popping corn, cooking oils such as partially hydrogenated soybean, cottonseed and/or sunflower oils, triglycerides, artificial flavoring, beta carotene, salt and some additional form of conventional food preservative—it being understood that the composition of the mass of food stuffs 30 forms no part of the present invention but rather serves simply to summarize what typically is found in a packet of microwaveable popcorn that is available for purchase in grocery stores and the like. In short, the selection and composition of a mass of food stuffs suitable for being "cooked" in a microwave oven is a subject that is well known to those skilled in the art, and need not be described further herein.

Referring again to FIG. 5, a "susceptor" for microwave energy is indicated generally by the numeral 40. As is conventional in the structuring of a container of food stuffs that is designed to be "cooked" in a cooking chamber of a microwave oven, some means such as the susceptor 40 ordinarily is provided for location adjacent to the mass of food stuffs 30 (normally at a location "beneath" the mass of food stuffs 30 when the mass of food stuffs 30 is positioned within the cooking chamber of a microwave oven) to intercept and receive cooking energy from the microwave energy that is transmitted through the cooking chamber of the oven, with the susceptor 40 serving to convert the microwave energy into heat energy that is transmitted to the mass of food stuffs 30 to assist in the cooking of the mass of food stuffs 30. In conventional practice, the susceptor 40 can take the form of either a separate device that is positioned in the container 10; or in more conventional practice, the susceptor 40 can take the form of a "printing" of suitable susceptor material onto selected portions of the container 10, such as onto the bottom member 16, as is indicated by the numeral 42 in FIG. 5—it being understood, however, that the composition or form that the susceptor 40 may take forms no part of the present invention; rather what has been illustrated and described serves simply to summarize what typically is found in a packet of microwaveable popcorn that is available for purchase in grocery stores and the like. In short, the construction, design and provision of suitable susceptor materials is well known to those skilled in the art, and need not be described further herein.

The members 14, 16 that comprise the container 10 may be formed of any of a wide variety of suitable materials that will permit passage therethrough of radiant energy of the type that will be used to cook the mass of food stuffs 30, such as microwave energy, and that will permit the members 14, 16 to be joined as by the perimetrically extending seam 18 to define the closed chamber 20, as has been described. In preferred practice, the members 14, 16 are formed from paper-like sheets that preferably have been coated or laminated so as to enhance the strength of the sheets, to provide a proper closed package that protects the food stuffs 30, and that will maintain its integrity during the cooking process so as to not spill or otherwise inadvertently discharge the contents of the chamber 20 into the cooking chamber of a microwave oven—it being understood, however, that the composition of the material from which the members 14, 16 are made forms no part of the present invention; rather what has been described serves simply to summarize what typically is found in the materials that comprise a packet of microwaveable popcorn that is available for purchase in grocery stores and the like. In short, the composition of materials used to form a microwaveable food package is well known to those skilled in the art, and need not be described further herein.

In operation, the container 10, formed as has been described so as to include a suitable susceptor 40, and containing a suitable mass of food stuffs 30, typically is inserted into the cooking chamber of a microwave oven (shown only in FIG. 23) and is subjected to radiant energy therein, with the energy causing the popping corn that is contained within the mass 30 to be "cooked" so as to "pop" and enlarge very substantially in volume as compared with the volume of the initial mass 30, whereby the container 10 is caused to "self-inflate" in the manner that is depicted progressively in FIGS. 1–4, and as has been described. During the "popping" of the popcorn, noise is generated of a "popping" type; and, depending on the character of the material from which the container 10 is constructed, some additional and interesting noises may be generated as by the unfolding and reshaping of the container 10 as it progresses through the stages depicted in FIGS. 1–4, by which arrangement, attention is drawn to the container 10 as it enlarges or "grows" in size and progressively alters its configuration, whereby the result is to provide a very interesting, often amusing, source of entertainment that takes place during a brief period of time, typically a few minutes in length, depending in part on the size of the mass 30 and in part on the character of the food stuffs that comprise the mass 30. If popping corn is the food being cooked, the cooking time typically requires about one to about six minutes, with the majority of the inflation of the container taking place during the latter half of the cooking process.

While the chamber 20 that is defined by the container 10 is described herein as being "closed," it is not necessarily "sealed," at least during the full term of a cooking process. As those skilled in the art of microwave container construction are well aware, the heating and/or cooking of many foods causes gases to be generated in a sufficiently large quantity that, if the cooking container were not provided with a means to "vent" such gases in the event of a buildup of significant pressure therein, the container could be caused to explode during the cooking process. Accordingly, it is quite customary to provide microwave food cooking containers that are, at least initially during a cooking process, "closed" so as to retain contents therein and prevent the entry of contaminants from outside the closed chamber of the container; but to provide a seam or juncture or structure which, under the influence of a pressure build up, will open slightly to permit a venting of excess gas to take place. It is intended that the containers to which reference is made in this document to not exclude the inclusion of such a vent provision (i.e., stating that the container or its chamber is "closed" is not to be interpreted herein as meaning "permanently sealed" but rather should be interpreted as permitting the inclusion of a vent provision to relieve excessive gas pressure build up when such is needed), as is will understood by those skilled in the art.

Figure 6:
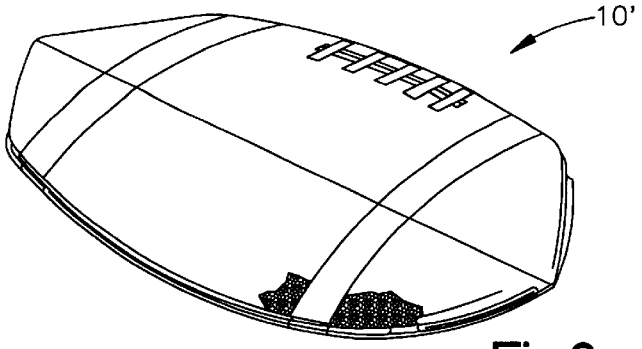
FIG. 6 is a perspective view of an alternate form of expansible food container which, in the essentially deflated or collapsed state that is shown in this view, has shape and appearance features that are characteristic of a football.
Figure 7:
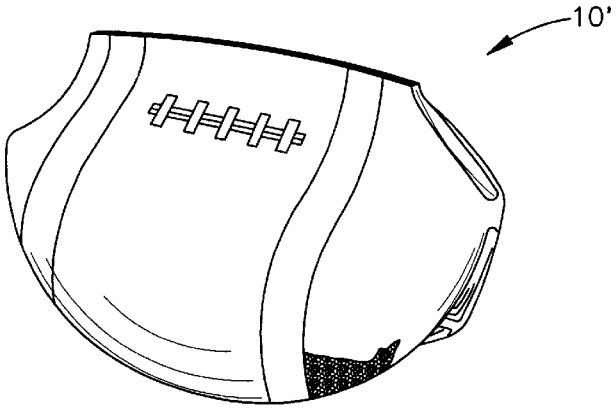
FIG. 7 is a perspective view of the container of FIG. 6 at about midway during its inflation or expansion process.
Figure 8:
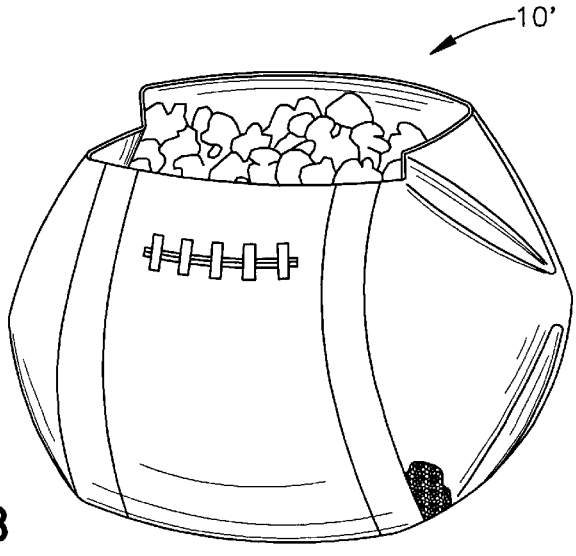
FIG. 8 is a perspective view of the container of FIG. 6 in its fully inflated or expanded state, and with the container being opened for serving of "popped" popcorn therefrom, with the expanded container being shaped like and having appearance features that are characteristic of a football.

While the container 10 that is depicted in FIGS. 1–4 has an initial folded configuration (as shown in FIG. 1) that is essentially rectangular and does little to disclose what form its ultimate expanded configuration will take, an alternate form of container 10' is depicted in FIGS. 6–8 that also forms a football shape when expanded, but which also has features that have something of a football appearance even when the container 10' is in its substantially flat, deflated, initial configuration, as is depicted in FIG. 6. FIGS. 7 and 8 show the container 10' at about midway during its inflation, and at the conclusion of its inflation, respectively, and show how the container 10' can be opened to access the "popped" popcorn contained therein. Except for the initial configurations of the containers 10, 10', the structure of the containers 10, 10' can be substantially identical.

Figure 9:
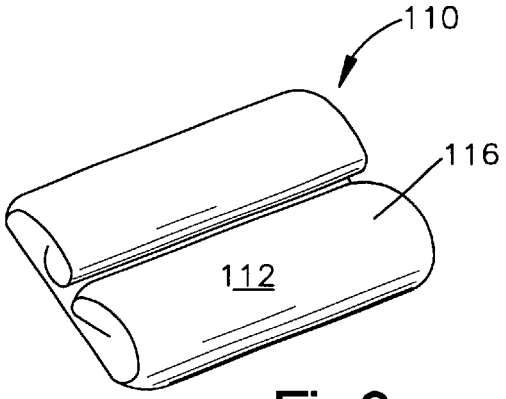
FIG. 9 is a perspective view of an expansible food container that embodies another form of the preferred practice of the present invention, with the container being depicted in an essentially deflated or collapsed state.
Figure 10:
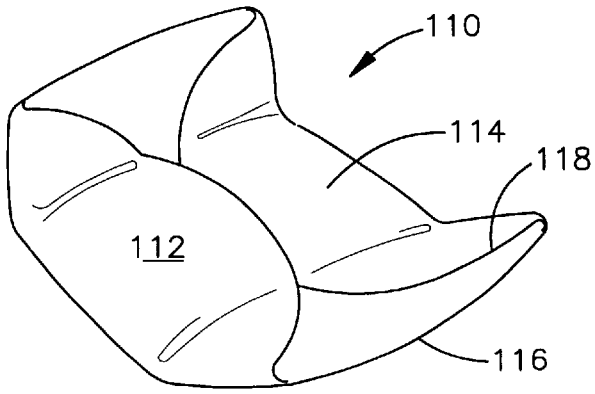
FIG. 10 is a perspective view similar to FIG. 9 but with the container being depicted during an early stage of inflation or expansion.
Figure 11:
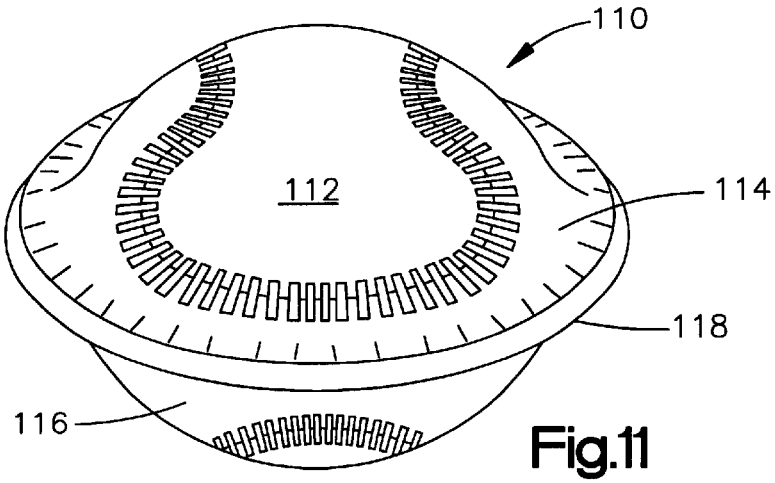
FIG. 11 is a perspective view thereof as the container is about midway through the inflation or expansion process.
Figure 12:
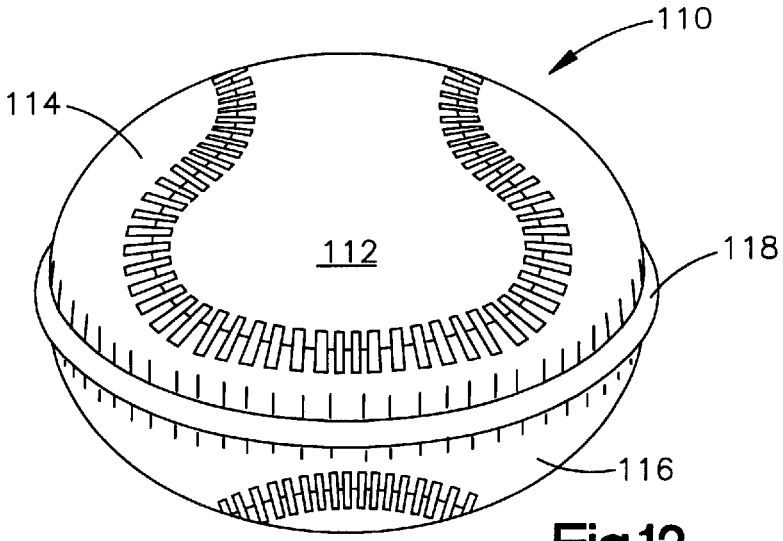
FIG. 12 is a perspective view of the container of FIG. 9 in its fully inflated or expanded state, and with the container being shaped like and having appearance features that are characteristic of a baseball.

Referring to FIGS. 9–12 (and shortly to the associated exploded view of FIG. 13), a food container embodying another form of the preferred practice of the present invention is indicated generally by the numeral 110. The container 110 initially takes a relatively flat, folded, essentially two-dimensional form that will be referred to as its "deflated form," which is depicted in FIG. 9. Inflation or expansion of the container 110 takes place progressively, successive partially inflated or expanded states being illustrated in FIGS. 10 and 11, and with the final fully inflated or fully expanded state of the container 110 being shown in FIG. 12.

As will be apparent from an examination of what is depicted in FIGS. 9–12, the container 110 has a relatively unobtrusive and substantially conventional, generally rectangular and folded appearance in its collapsed state, as is depicted in FIG. 9. However, as progressive expansion or inflation of the container 110 takes place, surface carried features of the expanding container structure 110 are brought into view and/or are progressively enlarged and enhanced in character as the container 110 unfolds and/or inflates so that the resulting structure takes on a three-dimensional character that is of interesting appearance. The expansion of the container 110 takes place in a way that is entertaining, perhaps even amusing, to view, and that tends to attract attention and to entertain the viewer, for what its surface carried features taken together with the configuration of its component parts combine to produce is a food container 110 that, in its fully inflated or expanded state, is shaped like and has appearance features that are characteristic of a baseball. Stated in another way, features of the present invention include the provision of printed surface features provided on outer surfaces of a container, of die-cut or otherwise specially formed container portions that serve to enhance the shape or configuration of the inflated or expanded container, and/or of a wide variety of other types of decorating work that can enhance the entertainment that is provided as a container is caused to expand under the influence of the expansion of contents being heated therein as by the application of radiant energy.

Figure 13:
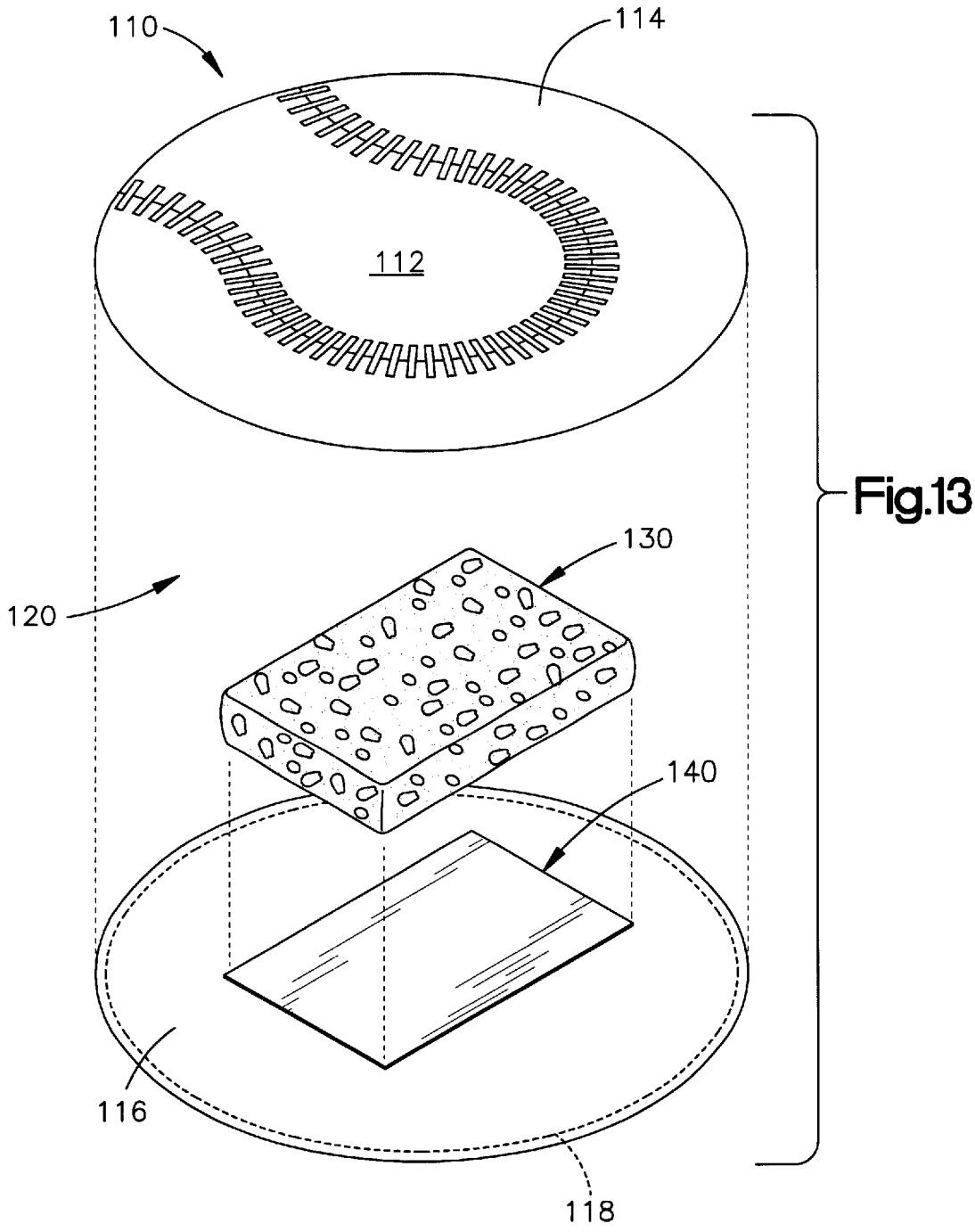
FIG. 13 is an exploded perspective view of components that comprise the food container of FIG. 9.

Referring to FIG. 13, the container 110 has an outer surface 112 that is formed from a pair of generally outwardly convex, somewhat semispherically shaped members 114, 116 that have been vacuum formed or otherwise shaped to depict such novelty features as opposed halves of a baseball. The members 114, 116 are closed along a perimetrically extending line or junction that is indicated by the numeral 118, whereby the members 114, 116 cooperate to define a closed chamber interiorally of the container 110. While a closed chamber is not, per se, depicted in FIG. 13, it is indicated generally by the reference numeral 120 which designates a space that is located between the members 114, 116 and about which the seam 118 extends. It is the chamber 120 that is expanded or inflated so as to expand the container 110 from its deflated state shown in FIG. 9 to its fully inflated state shown in FIG. 12, as has been explained in conjunction with the expansion of the container 10 and as is illustrated in FIGS. 1–4.

Referring again to FIG. 13, a mass of food stuffs contained within the closed chamber 120 is indicated generally by the numeral 130. The mass of food stuffs 130 preferably has the same features, characteristics and composition as has been described in conjunction with the mass of food stuffs 30.

Referring again to FIG. 13, a "susceptor" for microwave energy is indicated generally by the numeral 140. The susceptor 140 preferably has the same features, characteristics and composition as has been described in conjunction with the susceptor 40.

The members 114, 116 that comprise the container 110 may be formed of any of a wide variety of suitable materials, but preferably have the same features, characteristics and composition as has been described in conjunction with the members 14, 16.

In operation, the container 110 preferably is utilized and is caused to expand from its deflated to its inflated states in the manner that has been described in conjunction with the container 10.

Figure 14:
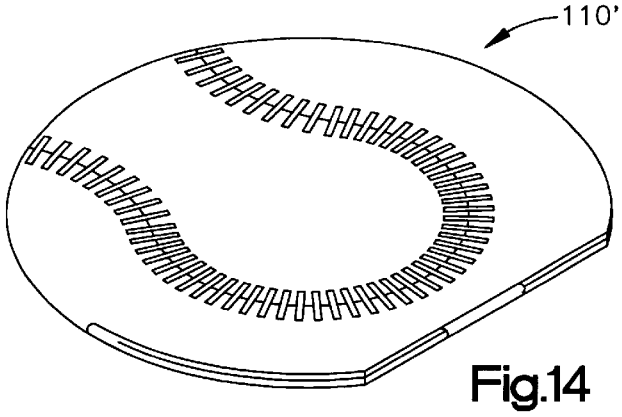
FIG. 14 is a perspective view of an alternate form of expansible food container which, in the essentially deflated or collapsed state that is shown in this view, has shape and appearance features that are characteristic of a baseball.
Figure 15:
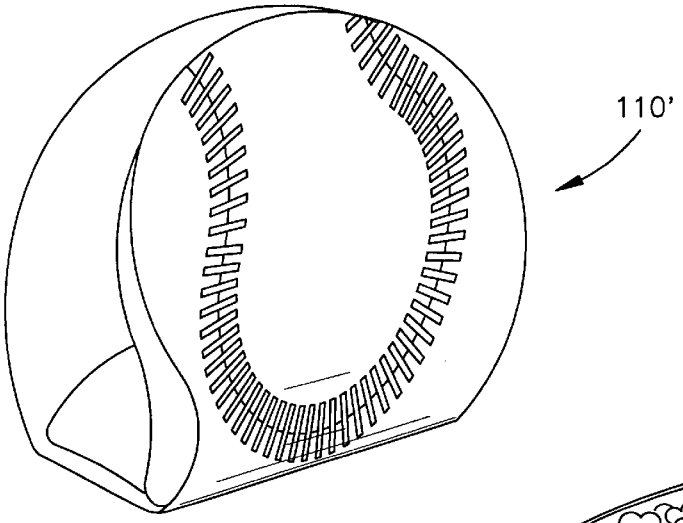
FIG. 15 is a perspective view of the container of FIG. 14 at about midway during its inflation or expansion process.
Figure 16:
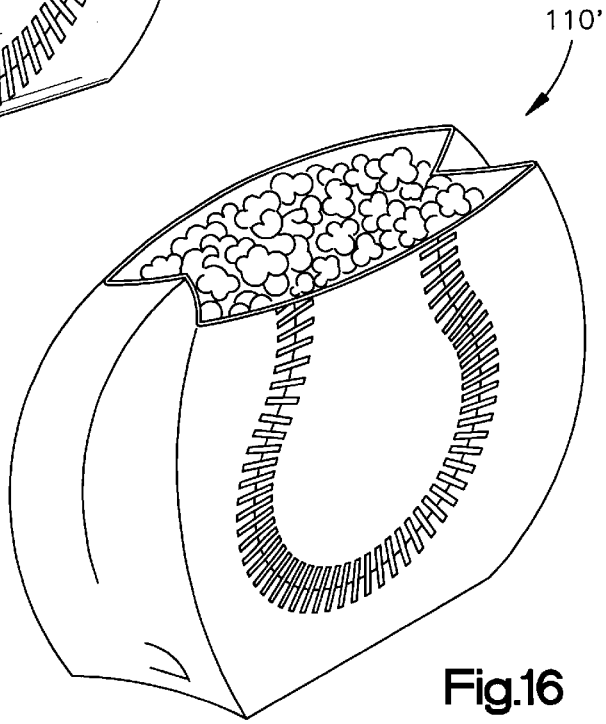
FIG. 16 is a perspective view of the container of FIG. 14 in its fully inflated or expanded state, and with the container being opened for serving of "popped" popcorn therefrom, with the expanded container being shaped like and having appearance features that are characteristic of a baseball.

While the container 110 that is depicted in FIGS. 9–12 has an initial folded configuration (as shown in FIG. 9) that is essentially rectangular and does little to disclose what form its ultimate expanded configuration will take, an alternate form of container 110' is depicted in FIGS. 14–16 that also forms a baseball shape when expanded, but which also has features that have something of a baseball appearance even when the container 110' is in its substantially flat, deflated, initial configuration, as is depicted in FIG. 14. FIGS. 15 and 16 show the container 110' at about midway during its inflation, and at the conclusion of its inflation, respectively, and show how the container 110' can be opened to access the "popped" popcorn contained therein. Except for the initial configurations of the containers 110, 110', the structure of the containers 110, 110' can be substantially identical; however, the container 110' is depicted as having more of a conventional bag-like construction which is more in conformance with what is utilized in present day microwave popcorn bag-like containers, as those skilled in the art will readily understand.

Figure 17:
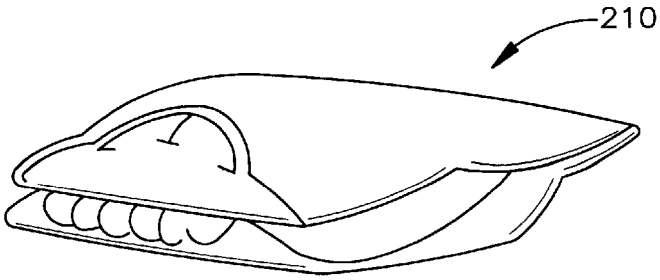
FIG. 17 is a perspective view of still another form of expansible food container that embodies features of the preferred practice of the present invention, with the container being depicted in an essentially deflated or collapsed state.
Figure 18:
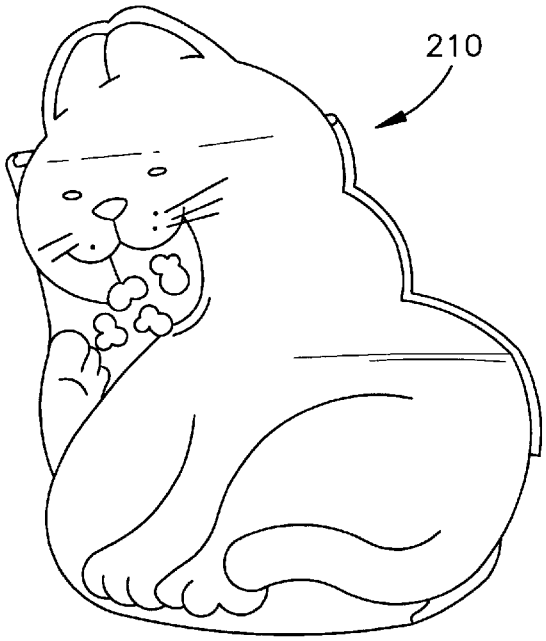
FIG. 18 is a perspective view similar to FIG. 17 but with the container being depicted at a stage about midway through the inflation or expansion process.
Figure 19:
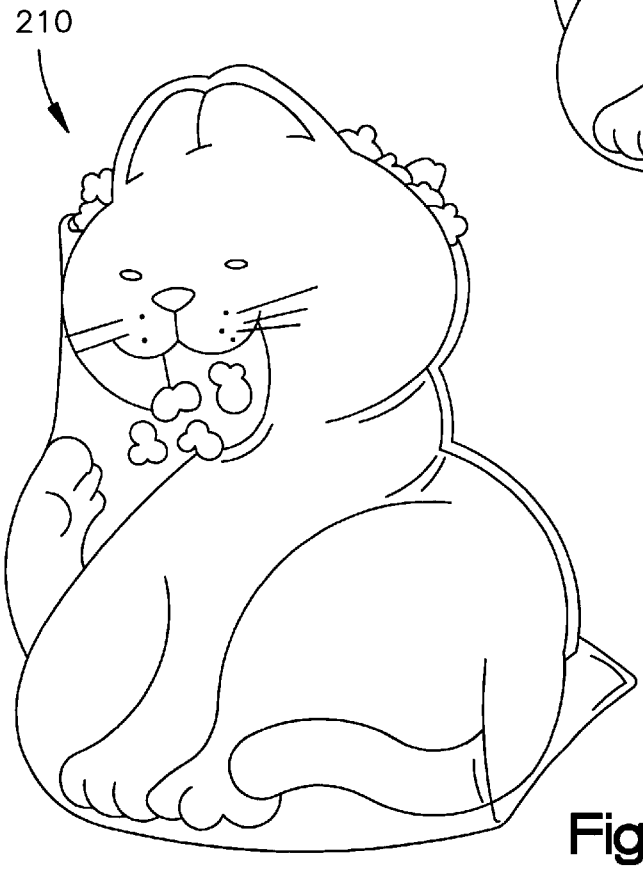
FIG. 19 is a perspective view similar to FIG. 18 but with the container being shown in its fully inflated or expanded state, and with the container being opened for serving of "popped" popcorn therefrom, with the expanded container being shaped like and having appearance features that form or display a character such as a cat or a bear.
Figure 20:
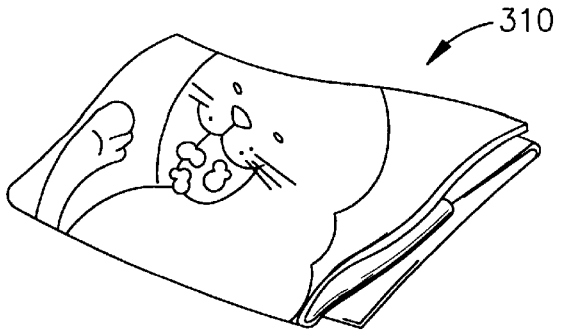
FIG. 20 is a perspective view of still another form of expansible food container that embodies features of the preferred practice of the present invention, with the container being depicted in an essentially deflated or collapsed state.
Figure 21:
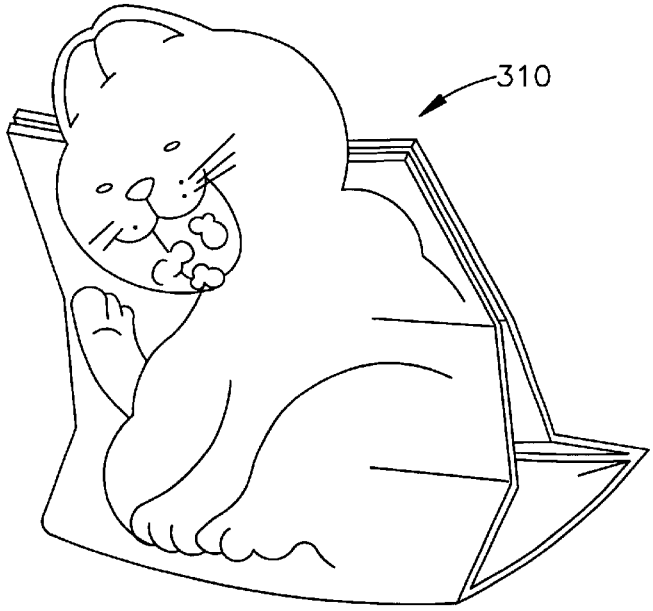
FIG. 21 is a perspective view similar to FIG. 20 but with the container being depicted at a stage about midway through the inflation or expansion process.
Figure 22:
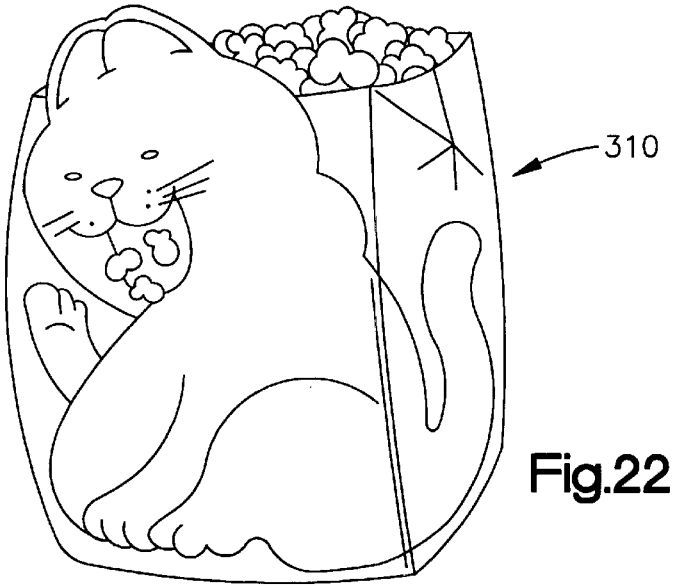
FIG. 22 is a perspective view similar to FIG. 21 but with the container being shown in its fully inflated or expanded state, and with the container being opened for serving of "popped" popcorn therefrom, with the expanded container being shaped like and having appearance features that form or display a character such as a cat or a bear.

Referring to FIGS. 17–19 and to FIGS. 20–22, two additional forms of food containers that embody features of the present invention are illustrated. While what is depicted in FIGS. 1–16 illustrates features of the present invention as applied to the generation of ball-shaped containers 10, 10', 110, 110', what is depicted in FIGS. 17–19 and 20–22 illustrates the application of features of the present invention to containers 210, 310 that form animal like figures that "come alive" during the viewable process of microwave cooking.

As is shown in FIGS. 17 and 20, the containers 210, 310 have initial folded or collapsed states that provide compact, substantially flat, generally rectangular packages that have appearances much like those that are available in grocery stores and the like containing microwaveable popcorn. However, unlike the conventional, bag-like containers which simply "swell" or "inflate" so as to enlarge their volumes during the microwave process wherein the popcorn contents of the bags are "popped," the containers 210, 310 have surface features that define stylized animals such as cats or bears or the like that are caused to sit upright or to stand erect as the bag-like structures that define the containers 210, 310 inflate or enlarge or unfold.

Figure 23:
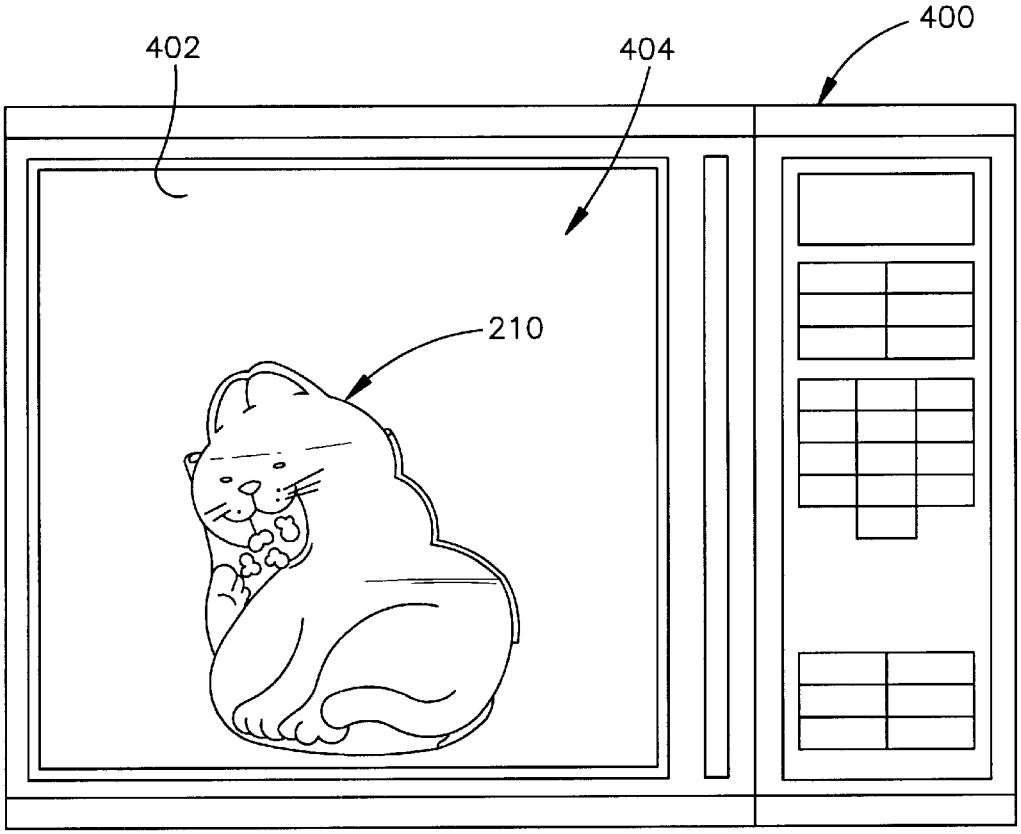
FIG. 23 is a front elevational view of a microwave oven of the type having a window that permits viewing into an illuminated cooking chamber of the oven, with the oven's cooking chamber shown housing the container of FIGS. 17–19, with the container being inflated or expanded to about the same extent as is depicted in FIG. 18; and, FIG. 24 is a perspective view of still another form of expansible food container that embodies features of the preferred practice of the present invention, with the container being depicted in an essentially deflated or collapsed state.

As is depicted in FIG. 23, when the unfolding or inflating of the container 210 is viewed through a door-carried window 402 of a microwave oven 400, the result is very much like the viewing of an interesting event on the screen of a television set. Inasmuch as both children and adults of present day society are familiar with and accustomed to witnessing the "unfolding" of events as by viewing the "window" of a television set, and inasmuch as the window 402 of a typical microwave oven 400 gives a clear view into an illuminated cooking chamber 404 of the oven 400 and provides an appearance that is not unlike that of the illuminated screen of a television set, a feature of the present invention resides in the capability that it provides to utilize a conventional microwave oven 400 in a way that is entertaining to both children and adults, and with respect to which both children and adults are almost instantaneously "comfortable" in utilizing.

Figure 24:
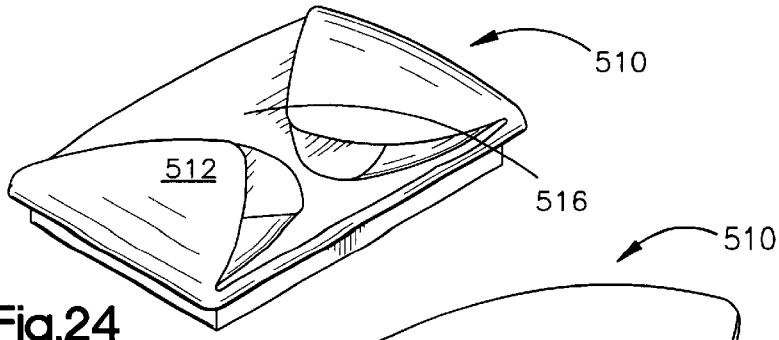
Figure 25:
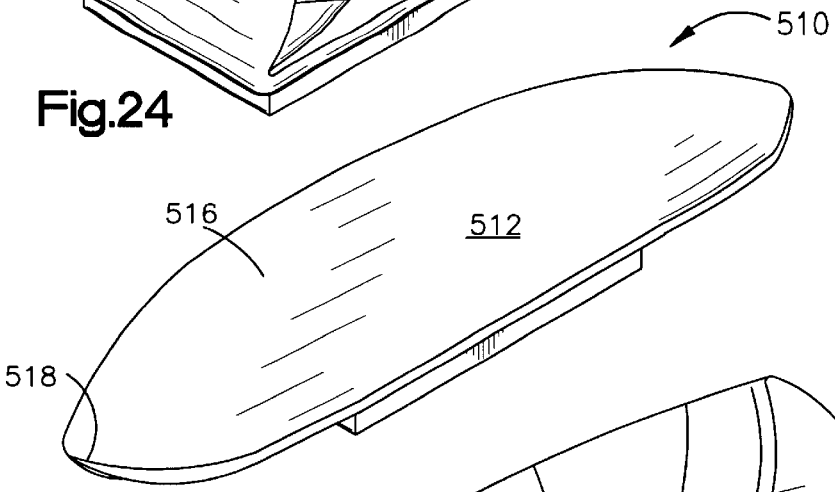
FIG. 25 is a perspective view similar to FIG. 24 but with the container being depicted during an early stage of inflation or expansion.
Figure 26:
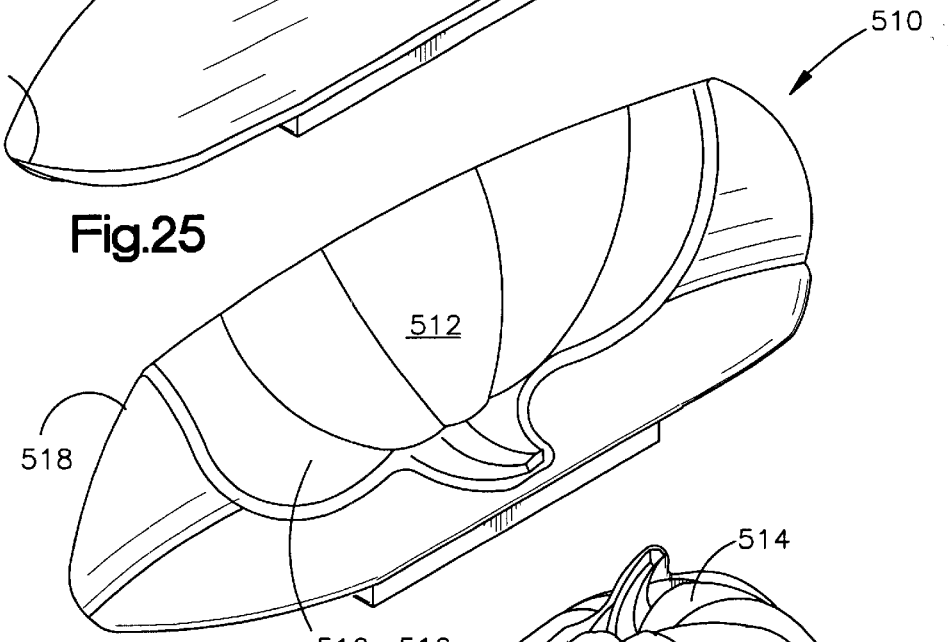
FIG. 26 is a perspective view similar to FIG. 25 but with the container being depicted at a stage about midway through the inflation or expansion process.
Figure 27:
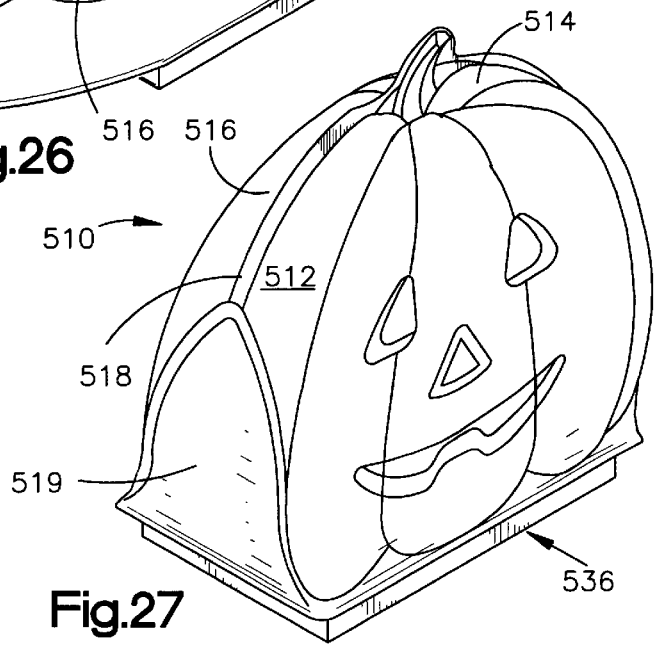
FIG. 27 is a perspective view similar to FIG. 26 but with the container being shown in its fully inflated or expanded state, and with the expanded container being shaped like and having appearance features that are characteristic of a pumpkin.

Referring to FIGS. 24–27 (and shortly to the associated exploded view of FIG. 28), a food container embodying another form of the preferred practice of the present invention is indicated generally by the numeral 510. The container 510 initially takes a relatively flat, folded, essentially two-dimensional form that will be referred to as its "deflated form," which is depicted in FIG. 24. Inflation or expansion of the container 510 takes place progressively, successive partially inflated or expanded states being illustrated in FIGS. 25 and 26, and with the final fully inflated or fully expanded state of the container 510 being shown in FIG. 27.

As will be apparent from an examination of what is depicted in FIGS. 24–27, the container 510 has a relatively unobtrusive and substantially conventional, generally rectangular and folded appearance in its collapsed state, as is depicted in FIG. 24. However, as progressive expansion or inflation of the container 510 takes place, surface carried features of the expanding container structure 510 are brought into view and/or are progressively enlarged and enhanced in character as the container 510 unfolds and/or inflates so that the resulting structure takes on a three-dimensional character that is of interesting appearance. The expansion of the container 510 takes place in a way that is entertaining, perhaps even amusing, to view, and that tends to attract attention and to entertain the viewer, for what its surface carried features taken together with the configuration of its component parts combine to produce is a food container 510 that, in its fully inflated or expanded state, is shaped like and has appearance features that are characteristic of a pumpkin. Stated in another way, features of the present invention include the provision of printed surface features provided on outer surfaces of a container, of die-cut or otherwise specially formed container portions that serve to enhance the shape or configuration of the inflated or expanded container, and/or of a wide variety of other types of decorating work that can enhance the entertainment that is provided as a container is caused to expand under the influence of the expansion of contents being heated therein as by the application of radiant energy.

Figures 28, 29:
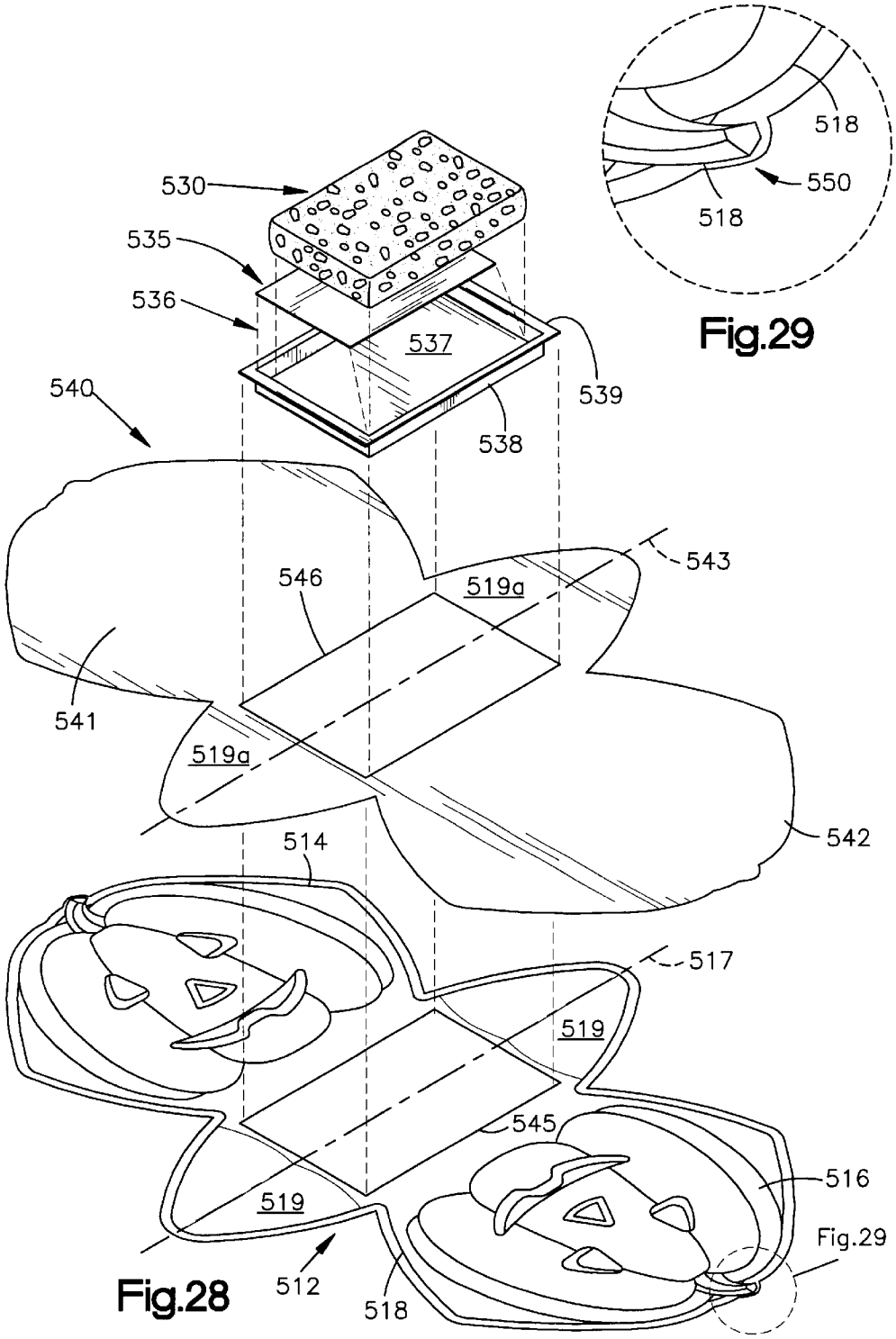
FIG. 28 is an exploded perspective view of the components that comprise the food container of FIG. 24.
FIG. 29 is an enlarged perspective view of a portion of the expanded container of FIG. 27, illustrating the heat sealed border narrowing down to a rupture or bursting portion designed to relieve excess pressure in the food container.

Referring to FIG. 28, the container 510 has an outer surface layer 512 (FIG. 24) that is formed from a pair of generally outwardly convex, somewhat semispherically shaped, outer panels or members 514, 516 that have been vacuum formed or otherwise shaped to depict such novelty features as opposed halves of a pumpkin. The outer members 514, 516 are preferably die-cut in one piece and folded along an axis 517, and then closed (i.e., heat sealed) along a perimetrically extending line or junction that is indicated by the numeral 518. Gussets 519 are formed along both sides of outer members 514, 516 to allow outward expansion of the container during inflation.

When folded and closed, the outer members 514, 516 cooperate to define a chamber interiorally of the container 510. It is this chamber that is expanded or inflated so as to expand the container 510 from its deflated state shown in FIG. 24 to its fully inflated state shown in FIG. 27, as has been explained in conjunction with the expansion of the container 10 and as is illustrated in FIGS. 1–4.

Referring again to FIG. 28, a mass of food stuffs is indicated generally by the numeral 530 which is contained within the chamber formed by outer members 514, 516. The mass of food stuffs 530 preferably has the same features, characteristics and composition as has been described previously in conjunction with the mass of food stuffs 30.

Referring again to FIG. 28, a "susceptor" for microwave energy is indicated generally by the numeral 535. The susceptor 535 preferably has the same features, characteristics and composition as has been described previously in conjunction with the susceptor 40.

Referring again to FIG. 28, the mass of food stuffs 530 and the susceptor 535 are located in a base portion or tray, indicated generally at 536. The tray 536 is formed from relatively rigid paperboard or other microwaveable material. The tray 536 includes bottom wall 537 and sidewalls 538 extending outwardly around the periphery of the bottom wall 537. The bottom wall 537 and sidewalls 538 are formed in one piece and/or secured together with, e.g., adhesives, to form a substantially leakproof receptacle for the susceptor 535 and the mass of food stuffs 530 which prevents hot oils from leaking out of the bottom of the microwaveable package during the cooking process. Finally, flanges 539 extend outwardly from the sidewalls 538 of tray 536 for attachment to the outer surface layer, as will be described herein in more detail. The tray also acts as a stable constant to the expansible container for automated packaging purposes.

The outer members 514, 516 that comprise the outer surface layer 512 of the container 510 may be formed of any of a wide variety of suitable materials such as the features, characteristics and composition as has been described previously in conjunction with the members 14, 16. However, the outer members 514, 516 are preferably formed from polyester, co-extruded film, such as Melinex 850F, manufactured by ICI films, Hopewell Va. This type of film is suitable for microwave ovens and has a heat seal surface, which in FIG. 28, is facing upward.

To prevent the outer members 514, 516 from heat sealing together in the microwave oven during cooking, an inner surface layer 540 formed from a pair of inner panels or members 541, 542 is adhesively secured (e.g., heat sealed) to the outer surface layer 512. The inner surface layer 540 has the same peripheral configuration as the outer surface layer 512, and includes gussets 519*a* formed along the sides thereof which match gussets 519 on the outer surface layer 512 and allow for outward Expansion of the container during inflation. The members 541, 542 of the inner surface layer 540 are also formed (e.g., die-cut) from polyester film such as Melinex 850F having the heat seal surface facing downward toward the heat seal surface of the outer surface layer in FIG. 28, The members 541, 542 of the inner surface layer 540 can also be vacuum formed or otherwise shaped in the same manner as the outer members 514, 516 of the outer surface layer 512.

The inner surface layer 540 has an outer peripheral dimension which is slightly less than the outer peripheral dimension of the outer surface layer 512 (for example, about ⅜" less), such that when the outer surface layer. 512 and the inner surface layer 540 are heat sealed together, a border of the heat seal surface is left around the periphery of the outer surface layer 512. Consequently, after heat sealing the inner and outer surface layers together, the outer members 514, 516 can then be folded along axis 517 (and inner surface layer 540 along fold axis 543) and heat sealed together to form the expansible container—the outer members 514, 516 being only heat sealed together around the perimetrically extending line or junction 518. The inner surface layer 540 has a non-heat sealing surface facing inwardly into the cavity so as to prevent heat sealing of the entire container during cooking.

Further, heat sealing only along the edges or border of the outer surface layer allows a seam or juncture which, under the influence of a pressure build up, will open slightly to permit a venting of excess gas to take place. More particularly, as Illustrated in FIG. 29, the dimensions of the inner and outer surface layers can be such that the border 518 can narrow down, for example along the neck of the pumpkin stem indicated generally at 550, or in another appropriate location, such that when a predetermined pressure is obtained in the chamber, the narrow, heat sealed portion will burst or rupture and allow venting of excess steam therethrough.

As another benefit of the present invention, the heat seal surface of the outer surface layer 512 can have graphics printed thereon. Since this surface is heat sealed to the inner surface layer 540, the graphics can therefore be trapped between the inner surface layer 540 and the outer surface layer 512 to prevent the graphic ink from contacting the food mass.

To attach the base portion or tray 536 to the inner and outer surface layers, the outer surface layer 512 and the inner surface layer 540 include corresponding openings 545, 546, respectively, which are formed by die-cutting in one step these layers after they have been heat sealed together. The openings form an aperture which is dimensioned to receive the tray and enable the under side of the flanges 539 on the tray to be attached to the inner and outer surface layers. To this end, conventional adhesive can be applied around the periphery of the aperture formed by openings 545, 546 and/or around the flange on the tray to secure the inner and outer surface layers to the tray.

In assembling the expansible container, the susceptor 535 is initially located in the tray 536 and attached (e.g., by adhesives) to the inside surface of the bottom wall 537 of the tray. The fold axis 517 on the outer surface layer is then aligned with the fold axis 543 in the inner surface layer, and the inner and outer surface layers are heat sealed together and the aperture die-cut therethrough. The tray is then located in the aperture and adhesively secured thereto. Next, the mass of food stuffs is introduced (e.g., poured as a molten mix) into the tray overlying the susceptor. The bottom wall 537 and sidewalls 538 act to contain the mass of food stuffs entirely within the tray. Finally, the inner and outer surface layers are folded along the axis 517, 543 and heat sealed along the line or junction 518 to form a sealed cavity. The above-described method, as will be appreciated, allows a common tray to be used (and pre-assembled with the susceptor and the mass of food stuff) for attachment within the aperture in the upper and lower surface layers for a variety of containers of the type herein described having surface portions with different appearances, designs or expressions thereon.

Figure 30:
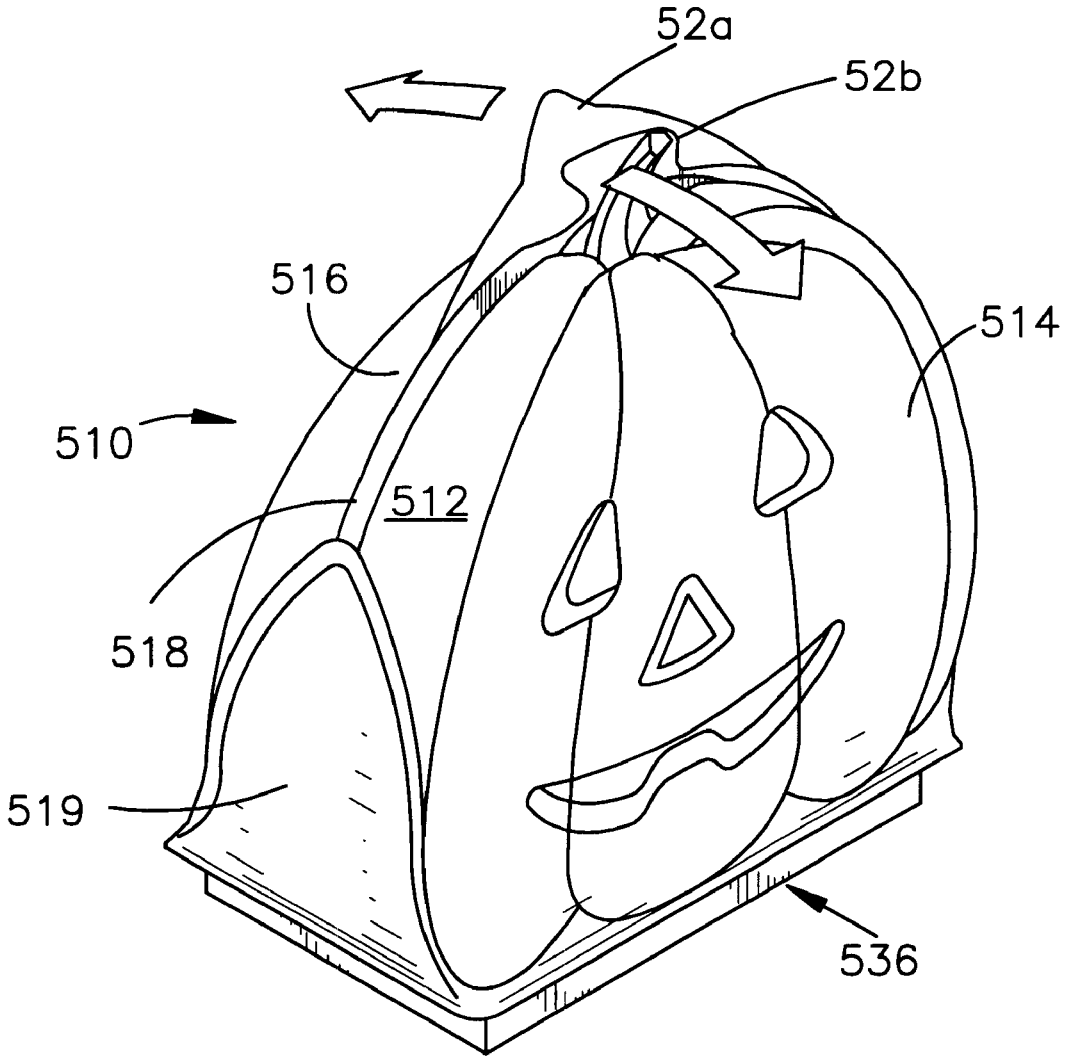
FIG. 30 is a perspective view of the container being shown in its inflated or expanded state similar to FIG. 27 but with tabs formed along the outer panels or members of the container to facilitate opening the container for serving of "popped" popcorn therefrom.

In operation, the container 510 preferably is utilized and is caused to expand from its deflated to its inflated states in the manner that has been described previously in conjunction with the container 10. However, to facilitate handling and serving the fully inflated container after the popcorn is fully "popped", a pair of tabs 552*a*, 552*b* can be formed integrally with the outer panels or members 514, 516, respectively, as illustrated in FIG. 30. In particular, tabs 552*a*, 552*b* can be formed as an extension of the inner and outer panels or members in an appropriate location, e.g., as part of the stem of the pumpkin, and each tab can include an inner layer of heat sealable material in face-to-face relation therewith to prevent the tabs from heat sealing together during cooking. After the cooking is complete, the tabs can be individually grasped and pulled apart, thereby separating the outer members along their heat-seal seam to provide access to the "popped" popcorn for serving. Moreover, the tabs provide a convenient handle for removing the container from the microwave oven after the popcorn is fully "popped" to prevent handling the hot container. In the case where the above-described tabs are formed on the container, the line or junction around which members 514, 516 are joined to form border 518 can be formed slightly below the perimeter of the panels at the location of the tabs to still allow sealing of the container and a vent location.

Although the invention has been described in its preferred form with a certain degree of particularity, it is understood that the present disclosure of the preferred form has been made only by way of example, and that numerous changes in the details of construction and the combination and arrangement of parts may be resorted to without departing from the spirit and scope of the invention as hereinafter claimed. It is intended that the patent shall cover, by suitable expression in the appended claims, whatever features of patentable novelty exist in the invention disclosed.

What is claimed is:

1. A microwave popcorn device comprising:

an inflatable container, a mass of unpopped popcorn disposed in said inflatable container, said mass of unpopped popcorn being adapted to be popped by exposure to microwave energy, and said mass of popcorn generating an inflation gas as it is popped by exposure to microwave energy, said inflatable container having a base portion adapted to rest on a food support surface of a microwave oven and having an inflatable portion which is substantially fully inflatable by inflation gas generated in said container as said mass of popcorn is popped, said inflatable portion of said container being preformed so as to be substantially fully inflatable into a predetermined three-dimensional external shape by inflation gas generated in said container, said predetermined three-dimensional shape being other than in the form of a bag or envelope and simulating the external configuration of an animate object, said inflatable portion of said container having graphic material on the exterior thereof, said graphic material combining with said three-dimensional external shape to visually detail the animate object in the three-dimensional external shape formed by said inflatable portion, and said inflatable container comprises a pair of flexible panels which are joined together and which cooperate to form said inflatable portion, each of said flexible panels being preformed to said predetermined three-dimensional external shape of the animate object, and at least one of said flexible panels having said graphic material which combines with said three-dimensional external shape to visually detail the recognizable character or article in the three dimensional shape formed by said one of said panels.

2. A microwave popcorn device comprising:

an inflatable popcorn containing vessel not having the appearance of a bag or envelope, a mass of unpopped popcorn disposed in said inflatable vessel, said mass of unpopped popcorn being adapted to be popped by exposure to microwave energy, and said mass of popcorn generating an inflation gas as it is popped by exposure to microwave energy, said inflatable vessel having a base portion adapted to rest on a food support surface of a microwave oven and having an inflatable portion which is substantially fully inflatable by inflation gas generated in said vessel as said mass of popcorn is being popped, said inflatable portion of said vessel having a preformed configuration so as to be substantially fully inflatable to a predetermined three-dimensional external shape, not recognizable as a popcorn containing bag or envelope, by inflation gas generated in said vessel, said predetermined three-dimensional shape being defined by the preformed configuration of the inflatable portion of the vessel to simulate the external configuration of an animate object, said inflatable portion of said vessel having graphic material on the exterior thereof, said graphic material combining with said three-dimensional external shape to provide an animated appearance to the vessel when said vessel is being inflated and to fully detail the animate object in the three-dimensional external shape formed by said inflatable portion after the container is fully inflated.

3. A microwave popcorn device as in claim 2, wherein said inflatable vessel comprises a pair of contoured flexible panels which are joined together and which cooperate to form said inflatable portion, each of said flexible panels having a preformed configuration to create said predetermined three-dimensional external shape of the animate object when the vessel is fully inflated, said predetermined three-dimensional shape being defined by the preformed configuration of said panels, and at least one of said flexible panels having said graphic material which combines with said three-dimensional external shape to detail the animate object represented by the three dimensional shape formed by said panels when the vessel is inflated.

4. A microwave popcorn device as in claim 3, wherein said pair of flexible panels are joined together around substantially the entire periphery thereof, a portion of each panel forming an outwardly extending tab, each tab facilitating access to the popcorn in the vessel when the vessel is fully inflated by grasping each tab and pulling the tab, and therefore each panel, outwardly to separate the panels along a portion of the joined periphery.

5. A microwave popcorn device as in claim 2, wherein said graphical material is provided about the entire periphery of the inflatable portion of said container.

6. A microwave popcorn device as in claim 5, wherein at least one of said panels is preformed in a non-planar contoured configuration.

7. A microwave popcorn device comprising:

an inflatable container, said inflatable container having a base portion with a bottom surface which can be located in adjacent, surface-to-surface contact with a food support surface of a microwave oven such that the entire base portion is supported in substantially planar relation to the food support surface, a mass of unpopped popcorn disposed only in the base portion of said inflatable container, said mass of unpopped popcorn being adapted to be popped by exposure to microwave energy, and said mass of popcorn generating an inflation gas as it is popped by exposure to microwave energy, said inflatable container also having an inflatable portion which is substantially fully inflatable by inflation gas generated in said container as said mass of popcorn is being popped during a predetermined time frame, said inflatable portion of said container having a preformed configuration so as to be substantially fully inflatable to a predetermined three-dimensional external shape by inflation gas generated in said container during said predetermined time frame, said predetermined three-dimensional shape being defined by said preformed configuration to simulate a recognizable character or article other than a bag or envelope, said inflatable portion of said container having graphic material on the exterior thereof, said graphic material combining with said three-dimensional external shape so as to provide graphic detail upon said container when said container is being inflated and to fully graphically detail the recognizable character or article in the three-dimensional external shape formed by said inflatable portion after the container is fully inflated.

8. A microwave popcorn device as in claim 7, wherein said base portion includes a bottom wall and side walls extending outwardly around the periphery of the bottom wall, said bottom wall and side walls forming a receptacle for the mass of unpopped popcorn, and said bottom wall having an outer surface which is designed to be disposed in adjacent, surface-to-surface contact with the food support surface of the microwave oven.

9. A microwave popcorn device as in claim 8, wherein a susceptor is interposed between the inner surface of the bottom wall of the receptacle and the mass of unpopped popcorn, said susceptor being designed to be heated by microwave energy in the microwave oven and to transfer the energy to the mass of unpopped popcorn to pop the popcorn during the predetermined timeframe.

10. A microwave popcorn device as in claim 8, wherein said inflatable container includes a pair of flexible panels which are sealed together around substantially the entire periphery thereof and are joined to and cooperate with the base portion to form said inflatable container.

11. A microwave popcorn device as in claim 10, wherein said pair of flexible panels includes an opening in which the base portion is located, said base portion being secured along the side walls to the portion of the panels surrounding the opening to form said inflatable container.

12. A microwave popcorn device as in claim 11, further comprising an inner flexible panel joined to each of said outer flexible panels, said inner panel being relatively smaller in surface area than the outer panels and being joined in surface-to-surface contact thereto so as to provide an unobstructed border around the periphery of the outer panels to enable the outer panels to be joined around the border thereof, wherein said inner panel further comprises an opening coincident with said opening in said pair of flexible panels to allow insertion of said base through said opening in said inner panel.

13. A microwave popcorn device as in claim 7, wherein said pair of flexible panels are joined together around substantially the entire periphery of each panel, a portion of the periphery each panel forming a gripping tab, wherein the gripping tabs of the panels are not joined together.

14. A microwave popcorn package comprising at least two flexible non-planar sheets of material having peripheral edges bonded together to form at inflatable cavity for containing popcorn, said sheets of material being cut and bonded together in a configuration which resembles a sports ball when the cavity is inflated by gas generated by microwave cooking of the popcorn.

15. A microwave popcorn package comprising at least two flexible non-planar sheets of material having peripheral edges bonded together and bonded to a substantially planar base for said package, said sheets of material being cut and bonded together in a configuration which resembles an animal when inflated by gas generated by microwave cooking of the popcorn.

16. A microwave inflatable popcorn package comprising artistic panels adhesively bonded at peripheral edges to form a sealed container having a three-dimensional appearance of an animal when the package is inflated, said panels formed from a generally symmetrical sheet folded along a fold line into generally symmetrical halves with coinciding peripheral edges of said symmetrical halves adhesively bonded together to form said inflatable package, symmetrical gussets formed by the periphery of the symmetrical sheet and folded with the symmetrical halves of the sheet to coincide with and be bonded to adjoining peripheral edges of the panels, an inner surface layer adhesively bonded to an inner surface of the symmetrical sheet and foldable with the symmetrical sheet, aligned centrally located openings in the symmetrical sheet and the inner surface, divided by the fold line, and dimensioned to receive a popcorn-holding tray, whereby said panels are folded about said tray and coinciding bonded peripheral edges of the symmetrical sheet opposite the fold line are positioned above the tray when a bottom surface of the tray is set upon a horizontal surface, said tray having a floor, walls extending upwardly from said floor, and a flange extending outwardly from a top edge of said walls, said walls defining an outer perimeter of said tray insertable through said openings from the side of said inner surface layer, said flange extending laterally beyond edges of said openings to contact a portion of said inner surface layer about said openings, said flange adhesively securable to the portion of said inner surface layer about said openings, and a microwave susceptor material within said tray.

17. The inflatable popcorn package of claim 16 further comprising gripping tabs which extend from the peripheral edges of the symmetrical sheet, wherein said gripping tabs extend beyond an adhesive bonding line which bonds the peripheral edges of the panels.

18. The inflatable popcorn package of claim 17 wherein the peripheral edges of the panels are bonded together along an adhesive bonding line which is spaced at varying distances from an absolute edge of the panels, whereby excessive pressure within the package can rupture a portion of the bonding line spaced a minimum distance from the absolute edge of the panels.

* * * * *